United States Patent [19]

Larrow

[11] 4,269,006

[45] May 26, 1981

[54] HOUSE ASSEMBLY WITH PREFABRICATED ELEMENTS

[76] Inventor: Kenneth Larrow, 1300 Belcher Rd. So., Largo, Fla. 33543

[21] Appl. No.: 72,360

[22] Filed: Sep. 5, 1979

Related U.S. Application Data

[63] Continuation of Ser. No. 855,986, Nov. 30, 1977, abandoned, which is a continuation-in-part of Ser. No. 723,809, Sep. 16, 1976, Pat. No. 4,071,984.

[51] Int. Cl.[3] ..... E04C 1/00

[52] U.S. Cl. ..... 52/79.1; 52/309.14; 52/474; 52/593

[58] Field of Search ..... 52/90, 92, 241, 243, 52/309.1, 309.4, 309.11, 309.15, 79.1, 79.12, 474, 593; 403/241, 232.1, 234, 237

[56] References Cited

U.S. PATENT DOCUMENTS

| | | | |
|---|---|---|---|
| 2,321,567 | 6/1943 | Wilson | 52/582 X |
| 2,618,028 | 11/1952 | Baker | 52/241 X |
| 2,908,048 | 10/1959 | Johnson | 52/474 X |
| 3,236,014 | 2/1966 | Edgar | 52/92 X |
| 3,308,583 | 3/1967 | Chaney | 52/92 |
| 3,415,026 | 12/1968 | Tillisch et al. | 52/241 X |
| 3,420,023 | 1/1969 | Gregori | 52/309.9 |
| 3,462,897 | 8/1969 | Weinrott | 52/309.11 |
| 3,465,488 | 9/1969 | Miller | 52/241 X |
| 3,665,662 | 5/1972 | Timbrook et al. | 52/92 X |
| 3,986,314 | 10/1976 | Moeller | 52/243 X |
| 4,037,379 | 7/1977 | Ozanne | 52/593 X |
| 4,071,984 | 2/1978 | Larrow | 52/309.4 X |
| 4,156,995 | 6/1979 | Zusman | 52/693 |
| 4,163,349 | 8/1979 | Smith | 52/241 |

*Primary Examiner*—J. Karl Bell
*Attorney, Agent, or Firm*—Stein & Frijouf

[57] ABSTRACT

A component building assembly is disclosed comprising a plurality of panels each having an inner and an outer skin with insulation interposed therebetween. The inner and outer skin of each of the panels extend beyond the insulation creating panel grooves about the perimeter of the panel. The insulation preferably comprises a substantially rigid foam insulation such as foam polystyrene, foam polyurethane or the like. The outer skin may comprise wood, aluminum or plastic, whereas the inner skin may be metallic, plasterboard, plastic or wood. A first support stud is secured to a slab or a horizontal joist. A first interpanel stud extends upwardly from the first support stud. A first panel is mounted with the panel grooves of adjoining ends at least partially receiving the first support stud and the first interpanel stud. A second interpanel stud is secured to extend upwardly from the first support stud and within a panel groove of the first panel. A second panel is mounted with the panel grooves of adjoining ends at least partially receiving the first support stud and the second interpanel stud. A third interpanel stud is secured to the first support stud and within the panel groove of the second panel. A second support stud is mounted in the top panel groove of the first and second panels and is secured to the interpanel studs to lock the panels between the studs while concealing the studs within the panel grooves. The foregoing abstract is merely a resume of one general application, is not a complete discussion of all principles of operation or applications, and is not to be construed as a limitation on the scope of the claimed subject matter.

14 Claims, 25 Drawing Figures

HOUSE ASSEMBLY WITH PREFABRICATED ELEMENTS

CROSS-REFERENCE TO RELATED PUBLICATIONS

This application is a continuation of my continuation-in-part application, Ser. No. 855,986 filed Nov. 30, 1977 now abandoned which in turn is a continuation-in-part application of Ser. No. 723,809 filed Sept. 16, 1976, now U.S. Pat. No. 4,071,984 issued Feb. 7, 1978. All matter disclosed and claimed in the aforesaid patent application is hereby incorporated by reference into this application.

BACKGROUND OF THE INVENTION

1. Field of the Invention

This invention relates to component building systems and parts therefore incorporating panels with grooves for cooperation with joists and studs for construction of buildings such as houses and the like. More specifically, the invention relates to a type of prefabricated construction which permits the easy construction of windows, doors and walls through the use of studs, panels and joists wherein the joists and studs are concealed within grooves within the panels.

2. Description of the Prior Art

Various patents have been granted on the construction of buildings with prefabricated wall elements. Generally these systems are complicated and cumbersome requiring a large variety of parts and panel elements. It is a prime object of most prefabricated building structures to reduce the number of individual parts and also reduce the construction site assembly time. It is reasoned that assembly within a manufacturing plant can be performed simpler, more efficiently and more economically than the same assembly performed on the construction site. This reasoning is based on the availability of large machines and semi-skilled labor within a manufacturing plant versus the portable machines and tradeworkers required for construction site assembly.

Unfortunately, most of the prior art systems have not reached popularity for one of several reasons. In many cases, the prefabricated building structures did not allow for variation of the floor plan to suit the requirements of the purchaser. These systems were generally too rigid and inflexible to make small modifications of the window or door placement within a building structure. As a result, construction site modification substantially increased the cost of the building structure and little if any gain was achieved by the building system.

Other prior art building systems which overcame the inflexibility of the building component system had the disadvantage of having the appearance of a "prefabricated building". The undesirable "prefabricated" appearance is one of the primary reasons component construction has not obtained widespread use. In theory, a prefabricated building structure should be stronger and more durable than a similar structure erected on the building site. Unfortunately, this reality has not come into being due to the "prefabricated" appearance of the existing prior art component building systems.

In my prior application, Ser. No. 723,809, filed Sept. 16, 1976, now U.S. Pat. No. 4,071,984 I disclosed a building structure incorporating prefabricated panels with grooved pillars and joists for assembling and supporting the panels in the construction of a building. This building structure was very versatile and was easily adapted to modification by the purchaser of the building. In addition, the building was well insulated and strong and durable. The only disadvantage of my prior building system is the exposure of the grooved pillars and joists which was objectional to some purchasers.

Therefor it is an object of this invention to provide an apparatus which overcomes the aforementioned inadequacies of the prior art devices and provides an improvement which is a significant contribution to the advancement of the building art.

Another object of this invention is to provide a component building system wherein the outer skin of each of the panels extends slightly beyond the inner skin for insuring proper mating of the outer skin of adjacent panels upon erection of the building structure thereby eliminatng the need for trim strips or exposed joints on the outer surface of the building.

Another object of this invention is to provide a component building system having a plurality of panels each having an inner and an outer skin with insulation means interposed therebetween. The inner and outer skins extend beyond the terminal ends of the insulation creating panel grooves about the perimeter of the panel. The panel grooves receive support and interpanel studs to lock the panels between the studs while concealing the studs within the panel grooves.

Another object of this invention is to provide a component building system wherein the panels may comprise solid wall panels, wall panels having windows, floor panels, wall panels having doors, or roof panels. Each of the panels is secured to the studs after assembly of the house through the use of a nail air hammer or the like. Accordingly, final nailing is not undertaken until the house is completely square.

Another object of this invention is to provide a component building system wherein the outer skin of each of the panels extends slightly beyond the inner skin for insuring proper mating of the outer skin of adjacent panels upon erection of the building structure thereby eliminating the need for trim strips or exposed joints on the outer surface of the building.

Another object of this invention is to provide a component building system incorporating metallic straps which encompass support studs and are secured to opposed sides of interpanel studs for locking the building into a permanent structure.

Other objects and a fuller understanding of this invention may be had by referring to the summary of the invention, the description and the claims, taken in conjunction with the accompanying drawings.

SUMMARY OF THE INVENTION

The invention may be incorporated into a component building system comprising a plurality of panels each panel having an inner and an outer skin. Insulation means such as foam polystyrene, foam polyurethane, fiber glass, foam concrete or other substantially rigid insulation materials are laminated between the inner and outer skins of the panel. The inner and outer skins may comprise a sheet of metallic material such as aluminum or may comprise wood, steel, plastic or the like. The inner and outer skins are preferably bonded to the insulation material by a suitable adhesive.

The inner and outer skins extend beyond the terminal ends of the insulation creating a panel groove around the perimeter of the panel. The outer skin may optionally extend slightly beyond the inner skin for insuring proper mating of the outer skins if adjacent panels upon assembly of the building system as will be hereinafter described.

For a wall panel for example, a support stud is secured to a substantially horizontal surface by fastening means. A first interpanel stud is secured in an upwardly extending relationship to the first support stud. A first of the plurality of panels is mounted with the panel grooves of adjoining ends of the first panel at least partially receiving the first support stud and the first interpanel stud on adjacent sides of the first panel. A second interpanel stud is secured in an upwardly extending relation to the first support stud and within the panel groove of the first panel. A second of the plurality of panels is mounted with the panel grooves of adjoining ends of the panel at least partially receiving the first support stud and the second interpanel stud on adjacent sides of the second panel. A third panel is secured in upwardly extending relation to the first support stud and within the panel groove of the second panel. A second support stud is mounted within the upper panel grooves of the first and second panels and is secured to the upper ends of the interpanel studs thereby locking the first and second panels in place. The grooves of the first and second panels conceal the studs within the panel grooves. The wall panels may comprise a solid wall panel, a window wall panel or a door wall panel. The panel may also take the form of a floor or roof panel. Sealing between the outer skin of adjacent roof panels may be accomplished by suitable taping of the panel joint and an application of roofing compound.

The panel grooves may be designed to acommodate a conventional wood building stud with the interpanel studs being a double thickness to be partially received by two adjacent panels. However, it should be understood that steel, aluminum or other metallic or plastic studs may be incorporated with this invention. For the wall panels, the bottom and side grooves are preferably designed for receiving a single thickness stud whereas the top groove of the wall panel is designed to receive a double thickness stud. Roof panels are mounted to the double thickness stud by the use of fastening means such as a bolt or the like. The interpanel studs are secured to the support studs by metallic straps which encompass the support studs and are secured to opposed sides of the interpanel stud.

This invention accordingly comprises an apparatus possessing the features, properties and the relation of elements which will be exemplified in the apparatus hereinafter described, and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DETAILED DESCRIPTION

Figures 1, 2, 3, 4, 12, 13, 14, 15, 16:
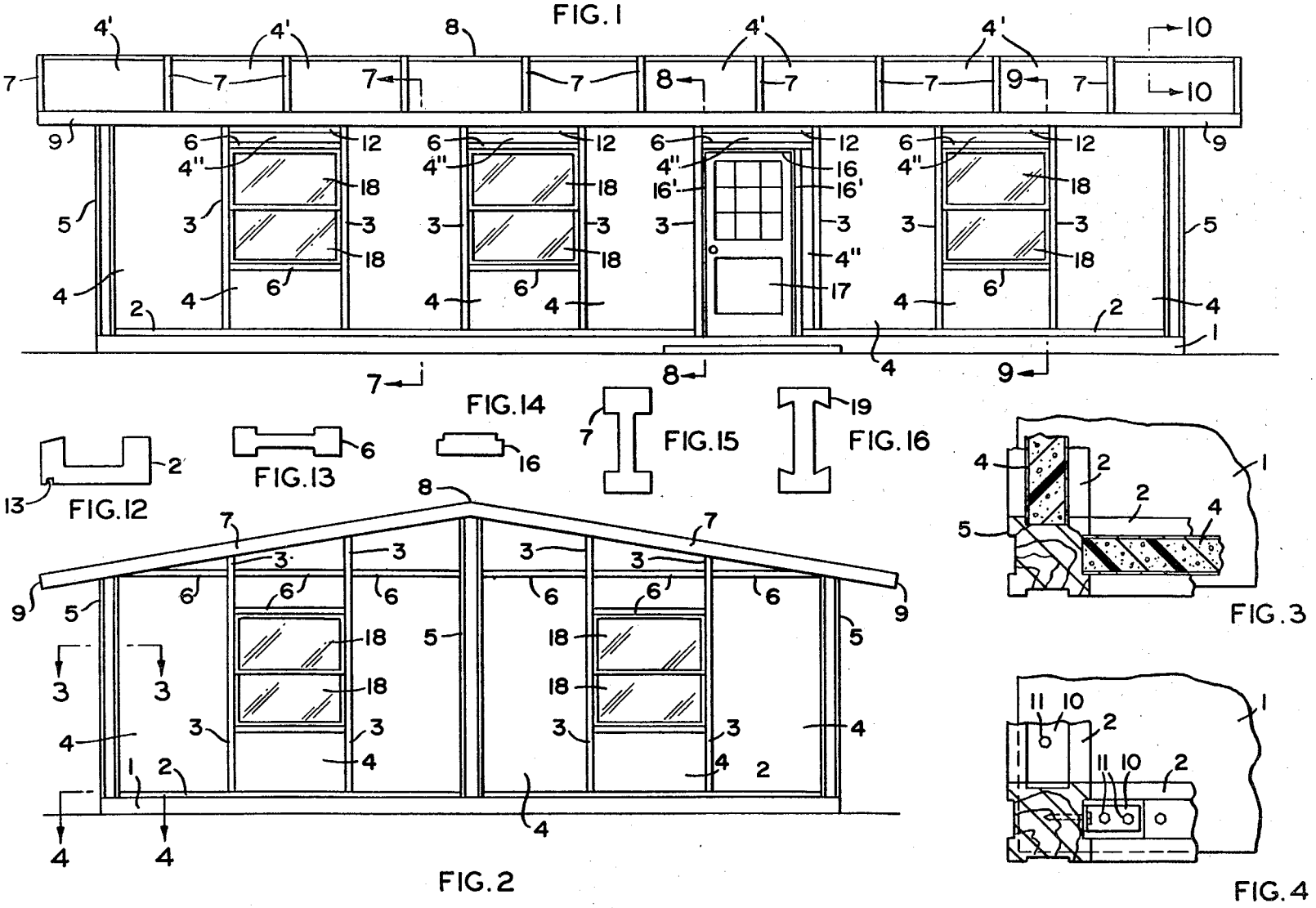
FIG. 1 is a front elevational view of a single story house made using the structural materials of this invention.
FIG. 2 is a side elevational vew of the same house.
FIG. 3 is a cross-sectional horizontal view of a corner structure of the house taken at line 3—3 of FIG. 2.
FIG. 4 is a cross-sectional horizontal view of the same corner taken at floor level at line 4—4 of FIG. 2.
FIG. 12 is a grooved joist or plate as shown in FIG. 9 having a single groove.
FIG. 13 is an end view of a grooved pillar or stud hving two grooves on opposite faces.
FIG. 14 is an end view of a spline receivable into the groove in FIG. 13 to form a door jamb or window frame.
FIGS. 15 and 16 are the end view of I-beams or beam studs having grooves for receiving panels.

FIGS. 1–11 illustrate a first embodiment of the invention. In FIGS. 1 and 2 a concrete or wooden floor or base 1 may be used to support the house. Horizontal singly grooved joist or plate 2 is laid on the base and doubly grooved pillars 3 rest on horizontal joist or plate 2 and extend vertically upward. Pillars 3 may be prefastened to joist 2 before the panels 4 are placed in position. Accordingly, the panels are inserted into the grooves in the pillars by raising the panels above the top end of the pillars and allowin the panels to slide downwardly with the vertical edges in the grooves of the pillars. Alternatively, the individual pillars may be positioned after each panel is positioned, followed by the positioning and fastening of an adjacent pillar. These panels and pillars are each, in most cases, of standard sizes, and may be used interchangeably with other panels or pillars. A typical standard panel size is 8 feet long, 4 feet wide and 3 inches thick for panels having a polystyrene core of $2\frac{1}{2}$–$2\frac{5}{8}$" and two sheet wood laminates of 3/16–$\frac{1}{4}$" each. Standard pillars have an overall cross-sectional dimension of $5\frac{1}{2}$"×$2\frac{1}{2}$" to $5\frac{1}{2}$" with 1, 2, 3 or 4 grooves therein, each of 3" wide and $\frac{1}{2}$to $1\frac{1}{4}$" depth.

Columns or posts 5 are used at the corners and in the center of the side wall to give greater support to the roof. These posts also have grooves therein at the appropriate place to receive the vertical edge of the panels placed next to them. In the corner posts these grooves are in two adjacent faces of the post. In the center post the grooves are in two opposite faces. At the top of each standard size panel 4 there is a horizontal joist 6 having a groove on the lower side to accommodate insertion of the top edge of panel 4. On the upper side, of the joist 6 a groove accommodates the lower edge of panel 4'. Panels 4' have different shapes and sizes to accommodate the wall area between joists 6 and the roof.

the roof comprises a number a parallel joists 7 shown in a slanted position in FIG. 2. Each joist 7, except the end joists, have two grooves therein on opposite sides to receive the panel sections 4'. Each panel preferably extends the full length of the roof from the peak 8 to the fron or back edge 9 of the roof.

The corner structure of the house as shown in FIG. 3 has a post having four grooves therein with two of the grooves on adjacent faces having panels 4 inserted therein.

In the corner structure at floor level shown in FIG. 4 the corner post 5 is firmly fastened to floor joists or plates 2 by brackets 10 which are held by bolts, nails or screws 11. These are fastened before the panels are inserted.

Figure 5:
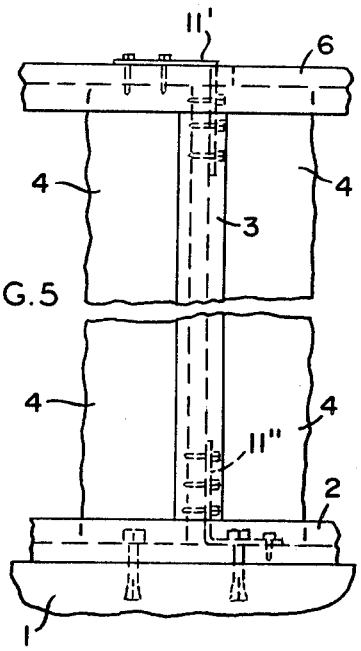
FIG. 5 is a side view showing the insertion of panels into a grooved pillar having grooves on opposite sides of the pillar, as well as top and bottom plates into which the panels are inserted into single grooves in the plates.

FIG. 5 also illustrates how the grooved pillars 3 are fastened to top joist 6 and base plate 2 by brackets 11' and 11'', respectively.

Figure 6:
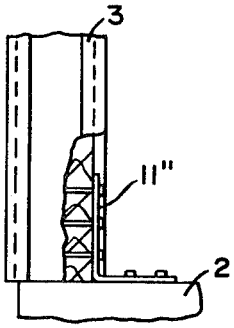
FIG. 6 shows the manner in which a pillar or stud may be fastened or bracketed to the floor.

FIG. 6 is another view showing the fastening of grooved pillar 3 to base plate 2 by bracket 11''.

Figure 7:
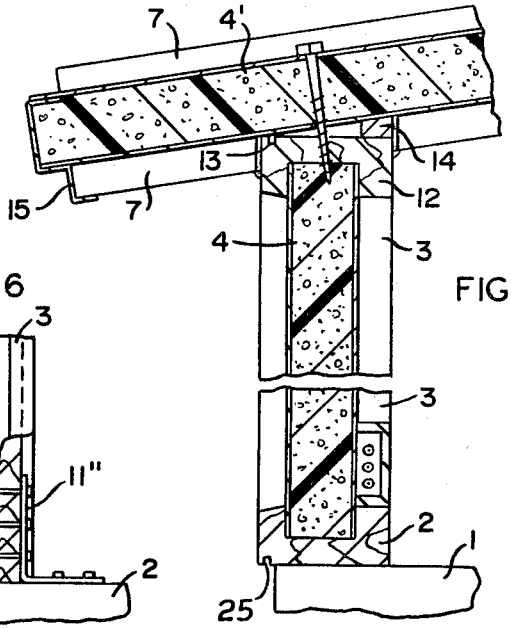
FIG. 7 shows the manner of joining a roof section and a wall section by a sectional view at 7—7 of FIG. 1.

In FIG. 7 a wall section is shown supporting a portion of a roof section. Base plate 2 forms the bottom of the wall with wall panel 4 supported by having its edges inserted into grooves in plate 2, pillar 3 and upper plate 12. Upper plate 12 is illustrated in FIG. 12 with an opening 13 which serves as a waterstop to prevent external water from penetrating. Shim 14 is positioned above top plate 12 to give additional support to the slanted roof panel which comprises grooved joist 7 or beam 20 and roof panel 4'. Bracket 15 is shaped to embrace the end of panel 4' and part of the end of joist 7 to protect the otherwise exposed end of the panel from drainage. This bracket may be made of aluminum, coated steel, plastic or the like to withstand weathering. A gutter may also be installed on the bracket. The bottom of base plate 2 has a lip 25 designed to prevent water which runs down the side of the wall from running under the plate. This lip increases the tendency of the water to drop off the edge of the base plate.

Figure 8:
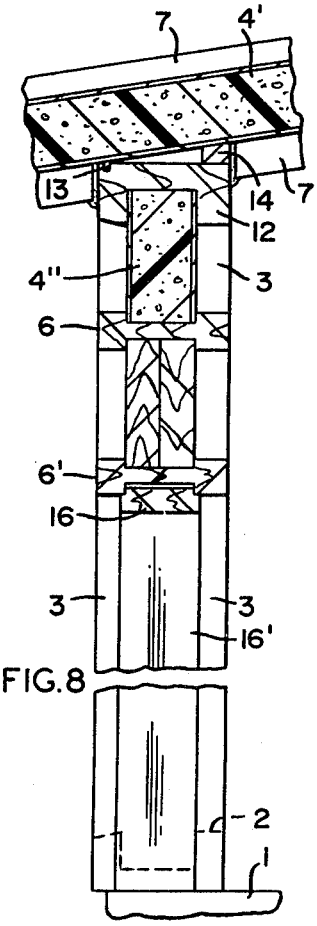
FIG. 8 is a cross-sectional vertical view of a door jamb structure taken at line 8—8 of FIG. 1.

The section in FIG. 8 illustrates the structure of the door frame taken at line 8—8 FIG. 1. Pillars 3 form a standard section into which standard sizes of panel are usually inserted. However, in forming a door frame, a spline 16' is inserted in the groove of the piller 3 against which the door will open and close. Joist 6' supports the upper part of the door frame with spline 16 inserted in the lower groove of joist 6' to form the top of the door frame. Another joist 6 is positioned above and parallel to joist 6' with two boards positioned between and in the facing grooves of said joists 6' and 6 to serve as structural headers. The upper groove in said joist 6 is fitted with a panel 4'' of appropriate size. In order to accommodate the desired door jamb size in a standard size panel space, the pillar 3 adjacent to the hinged side of the door is fitted with a narrow strip of panel 4'' of appropriate width to fill the space between pillar 3 and pillar 3' which will hold in the opposite groove vertical spline 16'' of the door jamb.

Figure 9:
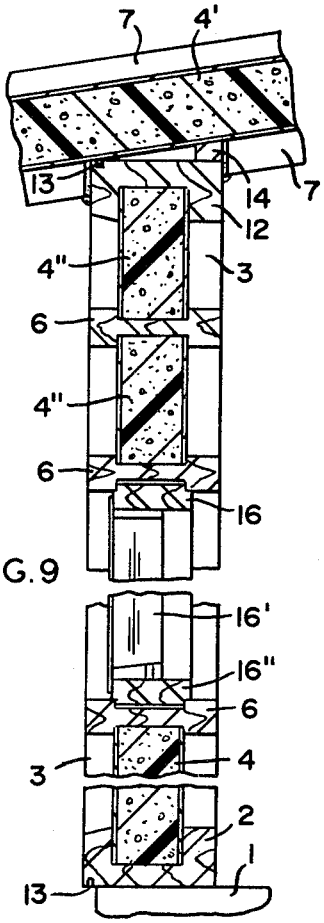
FIG. 9 is a cross-sectional vertical view of a window frame taken at line 9—9 of FIG. 1.

In FIG. 9 the window frame structure is illustrated as taken at line 9—9 of FIG. 1. In this case the window casements are approximately the size as the space between pillars 3. Below the windows 18, there is a wall section of appropriate height made from panel 4 inserted in the facing grooves of the same two pillars 3 and framed on the top by joist 6. The window frame is formed by inserting splines 16, 16' and 16'' in the facing grooves of top joist 6, pillars 3 and bottom joist 6, respectively.

Figure 10:
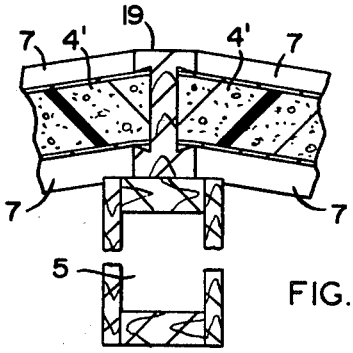
FIG. 10 is a cross-sectional vertical view of a roof section taken at line 10—10 of FIG. 1.
Figure 17:
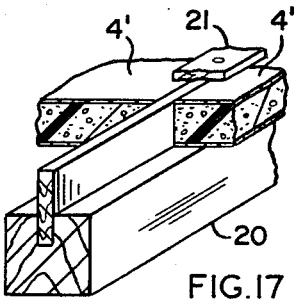
FIG. 17 shows a joist or modified I-beam in which the bottom portion 20 is much thicker than the top portion 21, with panel 4' being held in the grooves therebetween.

FIG. 10 illustrates the manner of joining the panels and joists at the peak of the roof. Beam 19 in cross-section is shaped in the form of an I with receding inner edges as shown. This beam preferably extends the length of the house. The roof panels 4' fit into the grooves of the I-shaped beam and the ends of the roof joists 7 abut into very close fitting contact with the top and bottom side edges of the I-beam. This I-beam 19 rests on supporting post 5 as shown more closely in FIG. 2.

Figure 11:
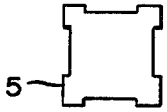
FIG. 11 is the end view of a grooved column or pillar having a groove on each of the four sides of the pillar.

FIG. 11 is the end view of a pillar or post having four grooves which may be used in the interior of a building where the corners of four rooms abut each other so that the four grooves may be used to support panels forming four walls. Such a post or pillar may also be used to form an interior or exterior section where three walls abut, or even to form a corner section where only two walls abut, in whch cases only the desired number of grooves will be occupied with panels to form the desired arrangement, for example as shown in FIGS. 3 and 4.

As described above, the various pillars and joists with one or more faces thereof having a linear groove as shown herein may be easily assembled with the panels described to construct the house shown in FIGS. 1 and 2.

Figure 18:
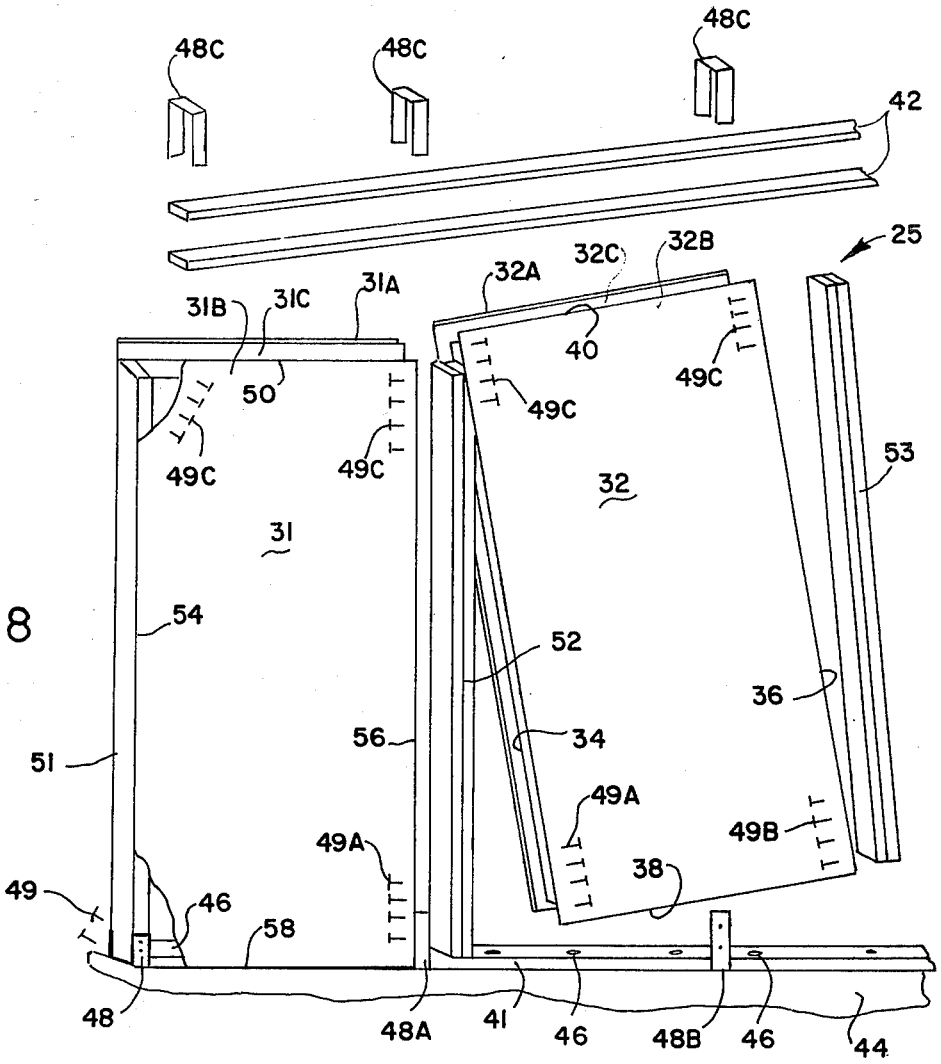
FIG. 18 is an exploded view of a second emobiment of the invention showing the assembly of a plurality of panels into a building stucture.

FIGS. 18–25 illustrate a second embodiment of the invention which is an improvement over the invention illustrated in FIGS. 1–17. FIG. 18 illustrates a component building system 25 having a plurality of panels shown as a first panel 31 and a second panel 32. The panels 31 and 32 are shown as substantially solid wall panels but it is understood that the assembly as hereafter described, is equally applicable for floor, roof or wall panels with integral door or window means. The panels 31 and 32 inlude inner skins 31A and 32A, respectively which may be a platerboard material, drywall, sheet wood, sheet metal, plastic or the like. Outer skins 31B and 32B may comprise a metallic material, woodk, plastic, or similar type of rigid skin material. Insulation means 31C and 32C is preferably a rigid foam type material such as polystyrene foam, polyurethane, fiberglass, foam concrete or other substantially rigid insulating materials. The inner skins 31A and 32A and other skins 31B and 32B are laminated to the insulating means 31C and 32C by suitable adhesive means. This lamination is done within the manufacturing plant and the panels are precut to preferably 4'×8' panels and stored for assembly on the construction site.

The inner skins 31A and 32A and the outer skins 31B and 32B, extend beyond the terminal ends of the insulation 31C and 32C, creating a panel groove about the perimeter of each of the panels 31 and 32. In wall panels 31 and 32, grooves at the sides 34, 36, 54 and 56 and grooves 38 and 53 at the bottom of the panel are capable of receiving a single thickness stud, preferably a 2×4 building stud. Top grooves 40 and 50 are capable of receiving a double thickness stud as will be hereinafter described.

Figure 19:
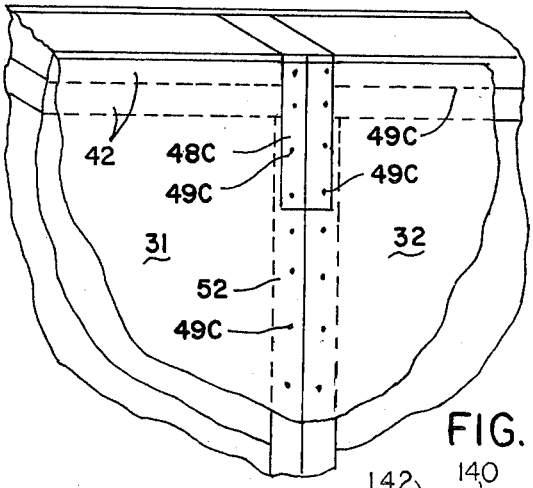
FIG. 19 is a partial enlarged view of the juncture of the assembled panels shown in FIG. 18.

A first support stud 41 is secured to a slab, for example 44, by suitable means such as drive pins, lead or plastic anchors with lag bolts or the like. The slab 44 may also be a floor constructed of panels similar to panels 31 and 32 assembled as will be hereinafter described. In that event, lag bolts or conventional nails may be used as fasteners 46. A first interpanel stud 51 is secured in upright extending relationship relative to the first support stud 41 by fastening means shown as a strap 48. The strap 48 completely encompasses first support stud 41 and may be fastened to opposed surfaces of first interpanel stud 51 by nails 49. The first panel 31 is mounted with the panel grooves on side 54 and bottom 58 respectively receiving the first interpanel stud 51 and the first support stud 41. A second interpanel stud 52 comprising a double thickness stud is secured to the first support stud 41 by strap 48A and nails 49A. The panel groove on side 56 of panel 31 partially receives the second interpanel stud 52 and more particularly, receives one-half of the stud 52. The second panel 32 is mounted with the grooves on side 34 and bottom 38 at least partially receiving studs 52 and 41. The panel grooves on sides 56 and 34 totally receive the second interpanel stud 52 such that sides 56 and 34 abut one another as shown in FIG. 19. A third interpanel stud 53 is then secured by a strap 48B in extending relation to the first support stud 41 and within the panel groove on side 36 of panel 32. A second support stud 42, shown as plural studs, in mounted within the grooves at the top edges 40 and 50 to be completely received therein. The second support stud 42 is secured by straps 48C and nails 49C for locking the first and second panels 31 and 32 between the studs while concealing the studs within the panel grooves.

FIG. 19 shows in more detail the upper connection of second interpanel stud 52 and the second support stud 42 by strap 48C and nails 49C. The strap 48C extends behind stud 52 in a manner similar to that shown in FIG. 19.

Figure 20:
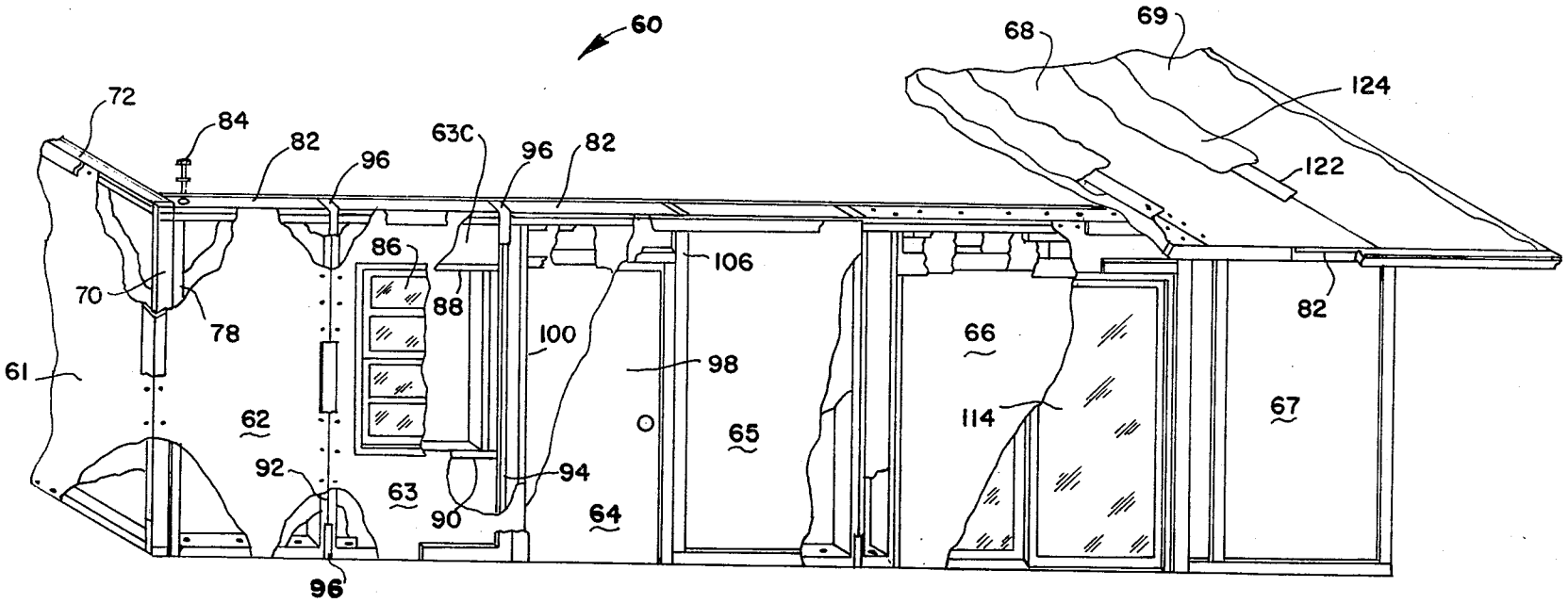
FIG. 20 is an elevational view partially in section of a building structure constructed in accordance with the invention shown in FIGS. 18 and 19.

FIG. 20 illustrates an improved building, shown as a residential building 60 incorporating the building structure shown in FIGS. 18 and 19. The building structure comprises wall panels 61–67 and roof panels 68 and 69. Panels 61 and 62 form a right angle corner which configuration is more clearly shown in an exploded view in FIG. 21 and in an assembled view in FIG. 22. Panel 61 receives an interpanel stud 70 and a top support stud 72. A strap 74 and nails 76 secure studs 70 and 72 to panel 61. An interpanel stud 78 is secured to interpanel stud 70 by a plurality of nails 80. The long dimension of interpanel stud 78 is established perpendicular to the long dimension of panel stud 70.

The panel 62 is specifically designed for a corner panel having the outer skin 62B extending substantially farther than the inner skin 62A for covering the exposed region of stud 70. A top support stud 82 is secured to stud 78 by a lag bolt 84. It should be appreciated that the panel 62 is one of a few panels which are specifically designed for a corner placemnt but are adaptable for cooperation with any standard panel as shown in FIGS. 18 and 19.

Panel 63 comprises a window 86 which is formed within the insulation 63C of panel 63. Framing studs 88 and 90 extend across panel 63 as shown in the sectioned portion. The interpanel studs 92 and 94 are secured to the terminal ends of window studs 88 and 89 by conventional nails. The panel 63 and the integral interpanel studs 92 and 94 are then secured to adjacent panels 62 and 64 by the straps 96 and nail as heretofore described.

Figure 23:
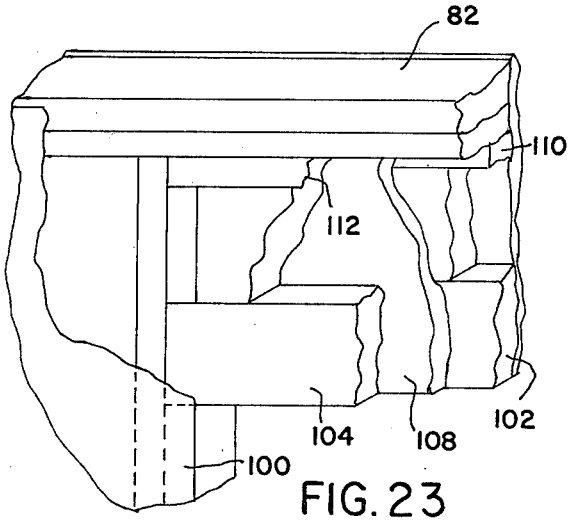
FIG. 23 is a magnified portion of a door header in a wall panel of FIG. 20.
Figure 24:
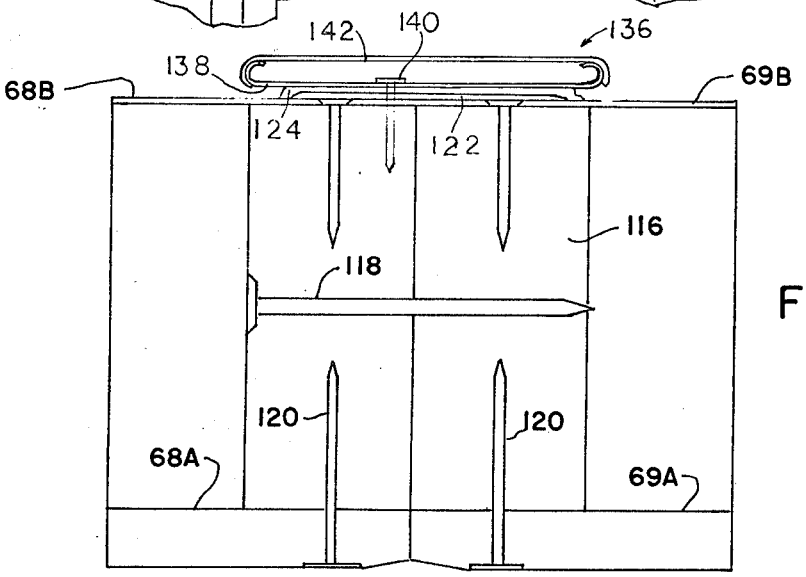
FIG. 24 is a magnified sectional view of the juncture of the roof panels shown in FIG. 20.

Panel 64 comprises a door 98 as an integral part of the panel 64. An upright stud 100 shown more clearly in FIG. 23, is connectable to the top support stud 82. Header beams 102 and 104 extend between stud 100 and the interpanel stud 106. A sheet board 108 adds reinforcement between the beams 102 and 104 and the top support stud 82 with beam 110 and 112 stabilizng board 108.

Panel 66 comprises a sliding glass door 114 which is fabricated in a manner similar to that shown in FIG. 23.

Roof panels 68 and 69 are secured to one another in a manner similar to the wall panels 61–67. This interconnection is more fully shown in FIG. 24 wherein the outer skins 68B and 69B are nailed to interpanel studs 116. Interpanel studs comprise plural studs secured together by nails 118. The inner skin 68A and 69A are likewise nailed to interpanel stud 116 by nails 120. An aluminum tape 122 having an integral adhesive is applied to cover the seam formed between outer skins 68B and 69B. A roofing compound 124, such as hydrocide elastomeric roofing, is then applied to cover the aluminum tape 122. An optional cover unit 136 comprising a base 138 is secured by nails 140 over the roofing compound 124. The base 138 may comprise a plurality of unit bases extending along the length of the seam between roof panels 68 and 69. A continuous cover element 142 snaps into place on base 138 to protect the roofing compound 124 from harmful rays of sunshine, weather and the like. The base unit 138 and the cover unit 142 may be made from the same material, for example, extruded aluminum.

Figure 25:
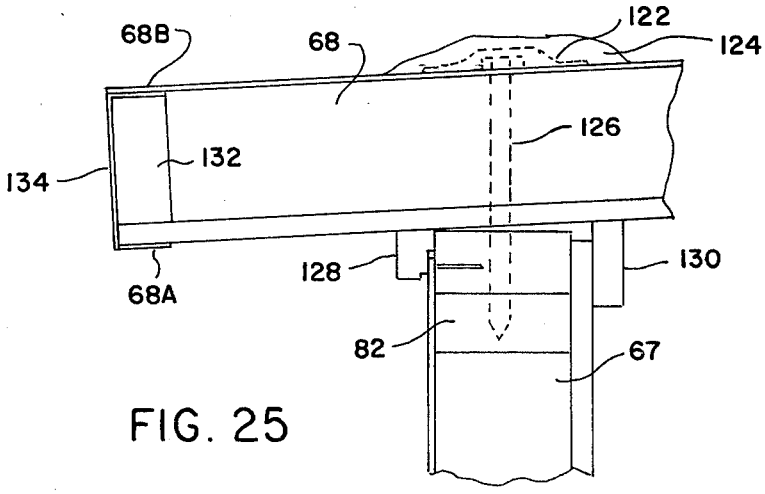
FIG. 25 is a magnified sectional view of the connection of the roof panels to the wall panels in FIG. 20.
Figure 22:
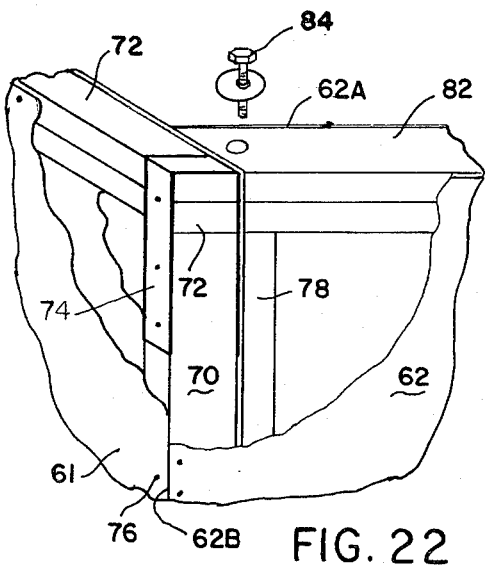
FIG. 22 is a magnified assembled view of the corner shown in FIGS. 20 and 21.
Figure 21:
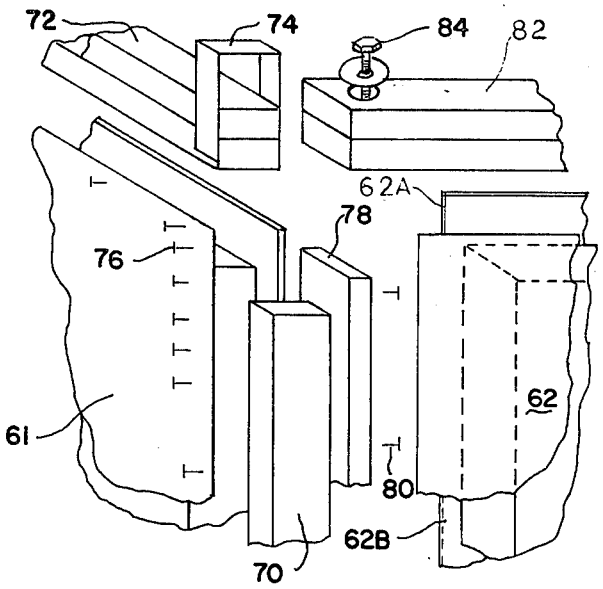
FIG. 21 is an exploded magnified partial view of the corner panels of the building structure shown in FIG. 20.

FIG. 25 is an enlarged sectional view showning the interconnection of roof panel 68 and wall panel 67. The roof 68 is secured to the top support stud 82 by a bolt 126. Trim moldings 128 and 130 aid in securing the orientation of the roof panel and seals the roof panel 68 to the wall panel 67. A stud 132 is secured to the end of roof panel 68 with a metal trim 134. The bolt 126 is covered by an aluminum tape 122 and roofing compound 124.

The foregoing has described a unique building system with examples of a typical building structure. It should be understppd that the invention lies in the concept and structural interrelation of the parts and the invention should not be construed to be limited to the specific configurations of the building illustrated.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and the scope of the invention.

Now that the invention has been described: I claim:

1. A component building system, comprising in combination:

a plurality of unitary panels each having an inner and an outer skin with insulation means secured therebetween;

said inner and outer skins extending beyond the terminal ends of said insulation means creating a panel groove about the perimeter of said panel;

a first support stud secured relative to the earth;

a first interpanel stud secured in extending relationship to said first support stud;

means for mounting a first of said plurality of panels with said panel groove on adjoining ends of said first panel at least partially receiving said first support stud and said first interpanel stud respectively;

a second interpanel stud secured in extending relationship to said first support stud and within said panel groove of said first panel;

means for mounting a second of said plurality of panels with said panel groove on adjoining ends of said second panel at least partially receiving said first support stud and said second interpanel stud respectively;

a third interpanel stud secured in extending relationship to said first support stud and within said panel groove of said second panel;

a second support stud mounted within said panel groove of said first and second panels and secured to said interpanel studs thereby locking said first and second panels between said stud while concealing said studs within said panel groove;

strap means disposed within said panel grooves for securing said interpanel stud to said support studs; and fastening means extending through said strap means into at least one of said studs for securing said studs together.

2. A system as set forth in claim 1 wherein said outer skin extends slightly beyond said inner skin for insuring proper mating of said outer skins of adjacent panels.

3. A system as set forth in claim 1, wherein said first support stud is secured to a substantially horizontal surface by fastening means.

4. A system as set forth in claim 1 wherein said second panel comprises a wall panel having window means.

5. A system as set forth in claim 1, wherein one of said pluality of panels comprises a floor panel.

6. A system as set forth in claim 1, wherein one of said panels comprises a wall panel having a door.

7. A system as set forth in claim 1, wherein said first and second panels comprises roof panels.

8. A system as set forth in claim 7, including tape means for sealing the seam between the outer skin of said first and second roof panels.

9. A system as set forth in claim 1, wherein said panel grooves are established to accommodate a conventional wood building stud; and said interpanel studs being a double thickness to be partially received by both said first and second panels.

10. A system as set forth in claim 1, wherein at least two of said plurality of panels comprises substantially rectangular wall panels;

the bottom and the side grooves of said wall panels being established for receiving a single thickness stud; and the top groove of said wall panels being established for receiving a double thickness stud.

11. A system as set forth in claim 1, wherein at least two of said plurality of panels comprises roof panels; and fastening means extending through said roof panels into said double thickness stud to secure said roof panels to said wall panels.

12. A component building system, comprising in combination:

a plurality of unitary panels each having an inner and an outer skin with insulation means secured therebetween;

said inner and outer skins extending beyond the terminal ends of said insulation means creating a panel groove about the perimeter of said panel;

a first support stud secured relative to the earth, a first interpanel stud secured in extending relationship to said first support stud;

means for mounting a first of said plurality of panels with said panel groove on adjoining ends of said first panel at least partially receiving said first support stud and said first interpanel stud respectively;

a second interpanel stud secured in extending relationship to said first support stud and within said panel groove of said first panel;

means for mounting a second of said plurality of panels with said panel groove on adjoining ends of said second panel at least partially receiving said first support stud and said second interpanel stud respectively;

a third interpanel stud secured in extending relationship to said first support stud and within said panel groove of said second panel;

a second support stud mounted within said panel groove of said first and second panels and secured to said interpanel studs thereby locking said first and second panels between said stud while concealing said studs within said panel grooves;

strap means disposed within said panel grooves for securing said interpanel stud to said support studs; and said strap means being substantially U-shaped for extending about said support stud with the legs of said strap means disposed adjacent opposed sides of said interpanel stud.

13. A component building system, comprising in combination:

a plurality of unitary panels each having an inner and an outer skin with insulation means secured therebetween;

said inner and outer skins extending beyond the terminal ends of said insulation means creating a panel groove about the perimeter of said panel;

a first support stud secured relative to the earth;

a first interpanel stud secured in extending relationship to said first support stud;

means for mounting a first of said plurality of panels with said panel groove on adjoining ends of said first panel at least partially receiving said first support stud and said first interpanel stud respectively;

a second interpanel stud secured in extending relationship to said first support stud and within said panel groove of said first panel;

means for mounting a second of said plurality of panels with said panel groove on adjoining ends of said second panel at least partially receiving said first support stud and said second interpanel stud respectively;

a third interpanel stud secured in extending relationship to said first support stud and within said panel groove of said second panel;

a second support stud mounted within said panel groove of said first and second panels and secured to said interpanel studs thereby locking said first and second panels between said stud while concealing said studs within said panel grooves;

strap means disposed within said panel grooves for securing said interpanel stud to said support studs;

fastening means for securing said strap means to said support studs; and said fastening means being inserted through one of said inner and outer skins to extend through said strap means into said studs.

14. A component building system, comprising in combination:

a plurality of unitary panels each having an inner and an outer skin with insulation means secured therebetween;

said inner and outer skins extending beyond the terminal ends of said insulation means creating a panel groove about the perimeter of said panel;

a first support stud secured relative to the earth;

a first interpanel stud secured in extending relationship to said first support stud;

means for mounting a first of said plurality of panels with said panel groove on adjoining ends of said first panel at least partially receiving said first support stud and said first interpanel stud respectively;

a second interpanel stud secured in extending relationship to said first support stud and within said panel groove of said first panel;

means for mounting a second of said plurality of panels with said panel groove on adjoining ends of said second panel at least partially receiving said first support stud and said second interpanel stud respectively;

a third interpanel stud secured in extending relationship to said first support stud and within said panel groove of said second panel;

a second support stud mounted within said panel groove of said first and second panels and secured to said interpanel studs thereby locking said first and second panels between said stud while concealing said studs within said panel grooves;

strap means disposed within said panel grooves for securing said interpanel stud to said support studs; and a plurality of nails driven through one of said inner and outer skins to pierce said strap means and extend into one of said studs to secure said strap means between said skin and said stud.

* * * * *